US006334605B1

(12) United States Patent
Kikuchi

(10) Patent No.: US 6,334,605 B1
(45) Date of Patent: Jan. 1, 2002

(54) PANTAGRAPH-TYPE JACK

(75) Inventor: Noriyuki Kikuchi, Kumagaya (JP)

(73) Assignee: Rikenkaki Kogyo Kabushiki Kaisha, Saitama (JP)

( * ) Notice: Subject to any disclaimer, the term of this patent is extended or adjusted under 35 U.S.C. 154(b) by 0 days.

(21) Appl. No.: 09/651,056

(22) Filed: Aug. 30, 2000

(30) Foreign Application Priority Data

May 9, 2000 (JO) ..... 12-142273

(51) Int. Cl.[7] ..... B66F 3/00

(52) U.S. Cl. ..... 254/126; 254/DIG. 1; 254/122

(58) Field of Search ..... 254/126, 122, 254/100, 101, 98, DIG. 1

(56) References Cited

U.S. PATENT DOCUMENTS 4,025,054 A * 5/1977 Yamazaki ..... 254/126
5,303,898 A * 4/1994 Engel et al. ..... 254/126
5,364,072 A * 11/1994 Engel ..... 254/126
5,975,497 A * 11/1999 Few et al. ..... 254/126
6,029,950 A * 2/2000 Yeh ..... 254/126
6,082,709 * 7/2000 Garceau ..... 254/126
6,161,816 A * 12/2000 Kikuchi ..... 254/126

FOREIGN PATENT DOCUMENTS

JP 3-6120 1/1991

* cited by examiner

*Primary Examiner*—Joseph J. Hail, III
*Assistant Examiner*—Lee Wilson
(74) *Attorney, Agent, or Firm*—Arent Fox Kintner Plotkin & Kahn, PLLC

(57) ABSTRACT

In a pantagraph-type jack, a base comprises an upper base member and a lower base member which are connected to each other relatively movably in the vertical direction, inner ends of a pair of lower arms are swingably connected to the upper base member via a pair of lower pivots arranged in the horizontal direction, lower sector gears are formed on the outer peripheries of the inner ends of the two lower arms, and a lower rack which meshes with the lower sector gears is disposed in the vertical direction and secured on the lower base member, and it is arranged such that at the same time as the two lower arms are erected the lower sector gears ascend the lower rack. Thus, the amount of lift of the load bearing platform can be increased without increasing the lengths of the lower arms, the upper arms and the threaded rod.

4 Claims, 7 Drawing Sheets

COLLAPSED STATE

PANTAGRAPH-TYPE JACK

BACKGROUND OF THE INVENTION

1. Field of the Invention

The present invention relates to a pantagraph-type jack and, in particular, an improved pantagraph-type jack, in which outer ends of a pair of lower arms disposed in a V-shaped manner whose inner ends are swingably connected to a base and outer ends of a pair of upper arms disposed in an inverted V-shaped manner whose inner ends are swingably connected to a load bearing platform are connected via first and second connecting shafts, and a threaded rod supported on the first connecting shaft in a rotatable but axially non-movable manner is screwed into a threaded bore provided in the second connecting shaft.

2. Description of the Prior Art

Such a pantagraph-type jack is already known as disclosed in, for example, Japanese Patent Publication No. 3-6120.

In such a pantagraph-type jack of the art, the degree of lift of the load bearing platform is increased by increasing the lengths of the lower arms, the upper arms and the threaded rod. However, when the lengths of the lower arms, the upper arms and the threaded rod are increased, the size of the jack increases and thus it is difficult to store it in a small storage space in an automobile, etc.

SUMMARY OF THE INVENTION

The present invention has been carried out in view of the above-mentioned circumstances, and it is an objective of the present invention to provide a compact pantagraph-type jack in which the degree of lift of the load bearing platform can be increased without increasing the lengths of the lower arms, the upper arms and the threaded rod.

In order to achieve the above-mentioned objective, the present invention provides firstly a pantagraph-type jack in which outer ends of a pair of lower arms disposed in a V-shaped manner whose inner ends are swingably connected to a base and outer ends of a pair of upper arms disposed in an inverted V-shaped manner whose inner ends are swingably connected to a load bearing platform are connected via first and second connecting shafts, and a threaded rod supported on the first connecting shaft in a rotatable but axially non-movable manner is screwed into a threaded bore provided in the second connecting shaft, wherein the base comprises an upper base member and a lower base member which are connected to each other relatively movably in a vertical direction, inner ends of the pair of lower arms are swingably connected to the upper base member via a pair of lower pivots arranged in a horizontal direction, lower sector gears are formed on outer peripheries of the inner ends of the two lower arms, and a lower rack which meshes with the lower sector gears is disposed in the vertical direction and secured on the lower base member.

In accordance with the above-mentioned first feature, when the threaded rod is rotated in a clockwise direction so as to erect each pair of lower arms and upper arms around the lower pivots and the upper pivots respectively in order to erect the collapsed or contracted jack, since the lower sector gears formed on the outer peripheries of the inner ends of the two lower arms rotate at the same time so as to ascend the lower racks, the upper base member having the lower pivots lifts relative to the lower base member having the lower racks. Therefore, the total amount of lift of the jack becomes the sum of the amount of lift of the load bearing platform due to the erection of the lower arms and the upper arms and the amount of lift of the upper base member relative to the lower base member, and thus the amount of lift can be increased in comparison with a jack of the prior art in which the amount of lift of the load bearing platform is determined only by the erection of the lower arms and the upper arms. Moreover, since it is unnecessary to specially increase the lengths of the lower arms, the upper arms and the threaded rod, the size of the jack is not made larger.

The present invention provides secondly a pantagraph-type jack in which the outer ends of a pair of lower arms disposed in a V-shaped manner whose inner ends are swingably connected to a base and outer ends of a pair of upper arms disposed in an inverted V-shaped manner whose inner ends are swingably connected to a load bearing platform are connected via first and second connecting shafts, and a threaded rod supported on the first connecting shaft in a rotatable but axially non-movable manner is screwed into a threaded bore provided in the second connecting shaft, wherein the load bearing platform comprises a lower load bearing platform member and an upper load bearing platform member which are connected to each other relatively movably in a vertical direction, inner ends of the pair of upper arms are swingably connected to the lower load bearing platform member via a pair of upper pivots arranged in the horizontal direction, upper sector gears are formed on the outer peripheries of the inner each of the two upper arms and an upper rack which meshes with the upper sector gears is disposed in the vertical direction and secured on the upper load bearing platform member.

In accordance with the above-mentioned second feature, when the threaded rod is rotated in the clockwise direction so as to erect each pair of lower arms and upper arms around the lower pivots and the upper pivots respectively in order to erect the collapsed jack, since the upper sector gears formed on the outer peripheries of the inner ends of the two upper arms rotate at the same time so as to push up the upper racks, the upper load bearing platform member having the racks lifts relative to the lower load bearing platform member having the upper pivots. Therefore, the total amount of lift of the jack becomes the sum of the amount of lift of the load bearing platform due to the erection of the lower arms and the upper arms and the amount of lift of the upper load bearing platform member relative to the lower load bearing platform member, and thus the amount of lift can be increased in comparison with a jack of the prior art in which the amount of lift of the load bearing platform is determined only by the erection of the lower arms and the upper arms. Moreover, since it is unnecessary to specially increase the lengths of the lower arms, the upper arms and the threaded rod, the size of the jack is not made larger.

The present invention further provides a pantagraph-type jack in which outer ends of a pair of lower arms disposed in a V-shaped manner whose inner ends are swingably connected to a base and outer ends of a pair of upper arms disposed in an inverted V-shaped manner whose inner ends are swingably connected to a load bearing platform are connected via first and second connecting shafts, and a threaded rod supported on the first connecting shaft in a rotatable but axially non-movable manner is screwed into a threaded bore provided in the second connecting shaft, wherein the base comprises an upper base member and a lower base member which are connected to each other relatively movably in a vertical direction, inner ends of the pair of lower arms are swingably connected to the upper base member via a pair of lower pivots arranged in a horizontal direction, lower sector gears are formed on outer peripheries of the inner ends of the two lower arms, and a lower rack which meshes with the lower sector gears is disposed in the vertical direction and secured on the lower base member, and the load bearing platform comprises a lower load bearing platform member and an upper load bearing platform member which are connected to each other relatively movably in a vertical direction, inner ends of the pair of upper arms are swingably connected to the lower load bearing platform member via a pair of upper pivots arranged in the horizontal direction, upper sector gears are formed on the outer peripheries of the inner ends of the two upper arms, and an upper rack which meshes with the upper sector gears is disposed in the vertical direction and secured on the upper load bearing platform member.

In accordance with the above-mentioned third feature, when the threaded rod is rotated in a clockwise direction so as to erect each pair of lower arms and upper arms around the lower pivots and the upper pivots respectively in order to erect the collapsed jack, since the lower sector gears formed on the outer peripheries of the inner ends of the lower arms rotate at the same time so as to ascend the lower racks, the upper base member having the lower pivots lifts relative to the lower base member having the lower racks, and since the upper sector gears formed on the outer peripheries of the inner ends of the upper arms rotate at the same time so as to push up the upper racks, the upper load bearing platform member having the racks lifts relative to the lower load bearing platform member having the upper pivots. Therefore, the total amount of lift of the jack becomes the sum of the amount of lift of the load bearing platform due to the erection of the lower arms and the upper arms, the amount of lift of the upper base member relative to the lower base member and the amount of lift of the upper load bearing platform member relative to the lower load bearing platform member, and thus the amount of lift can be increased to a great extent in comparison with a jack of the prior art in which the amount of lift of the load bearing platform is determined only by the erection of the lower arms and the upper arms. Moreover, since it is unnecessary to specially increase the lengths of the lower arms and the upper arms, the size of the jack is not made larger.

In addition to any one of the first to the third features, the present invention fourthly provides a pantagraph-type jack, wherein the rack comprises a plurality of pins which are inserted in a vertical array on the corresponding one of the lower base member and upper load bearing platform members, and both sides of these pins are made to mesh with a corresponding pair of sector gears.

In accordance with the above-mentioned fourth feature, one rack which is shared by a corresponding pair of sector gears will suffice and thus the arrangement can be simplified.

The above-mentioned objectives, other objectives, characteristics and advantages of the present invention will become apparent from an explanation of a preferable embodiment which will be described in detail below by reference to the attached drawings.

DESCRIPTION OF PREFERRED EMBODIMENTS

A preferred embodiment of the present invention is explained below by reference to the attached drawings.

Figure 1:
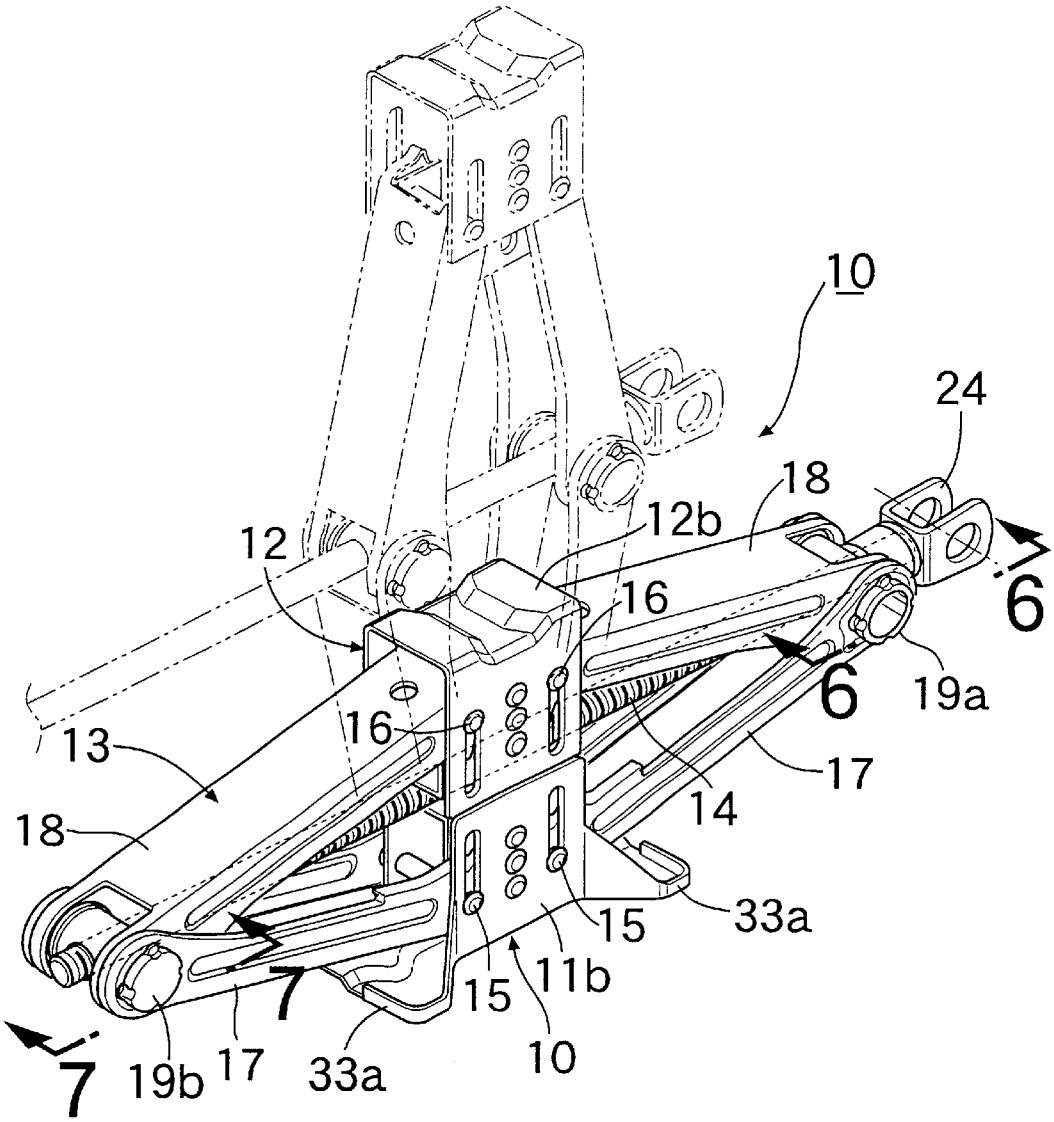
FIG. 1 is a perspective view of a pantagraph-type jack of an embodiment of the present invention.

In FIG. 1 a jack 10 is of the so-called pantagraph type in which four link arms are connected in a pantagraph state and comprises a base 11, a load bearing platform 12 provided just above the base 11, a link mechanism 13 for linking the base 11 and the load bearing platform 12 and a threaded rod 14 for lifting the load bearing platform 12 up and down by driving the link mechanism 13.

Figure 2:
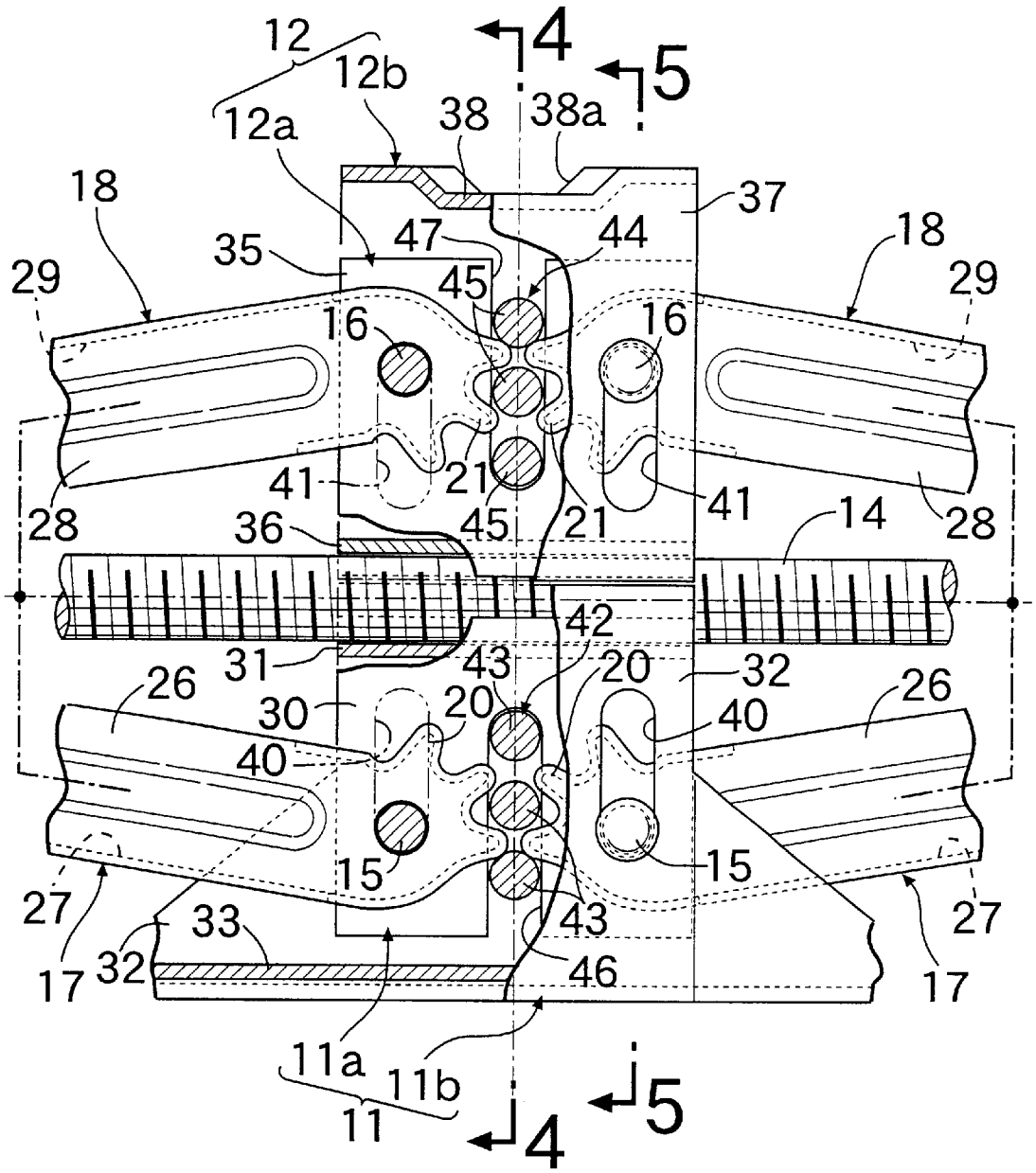
FIG. 2 is a partially cut away front view showing a state in which the jack is collapsed.
Figure 4:
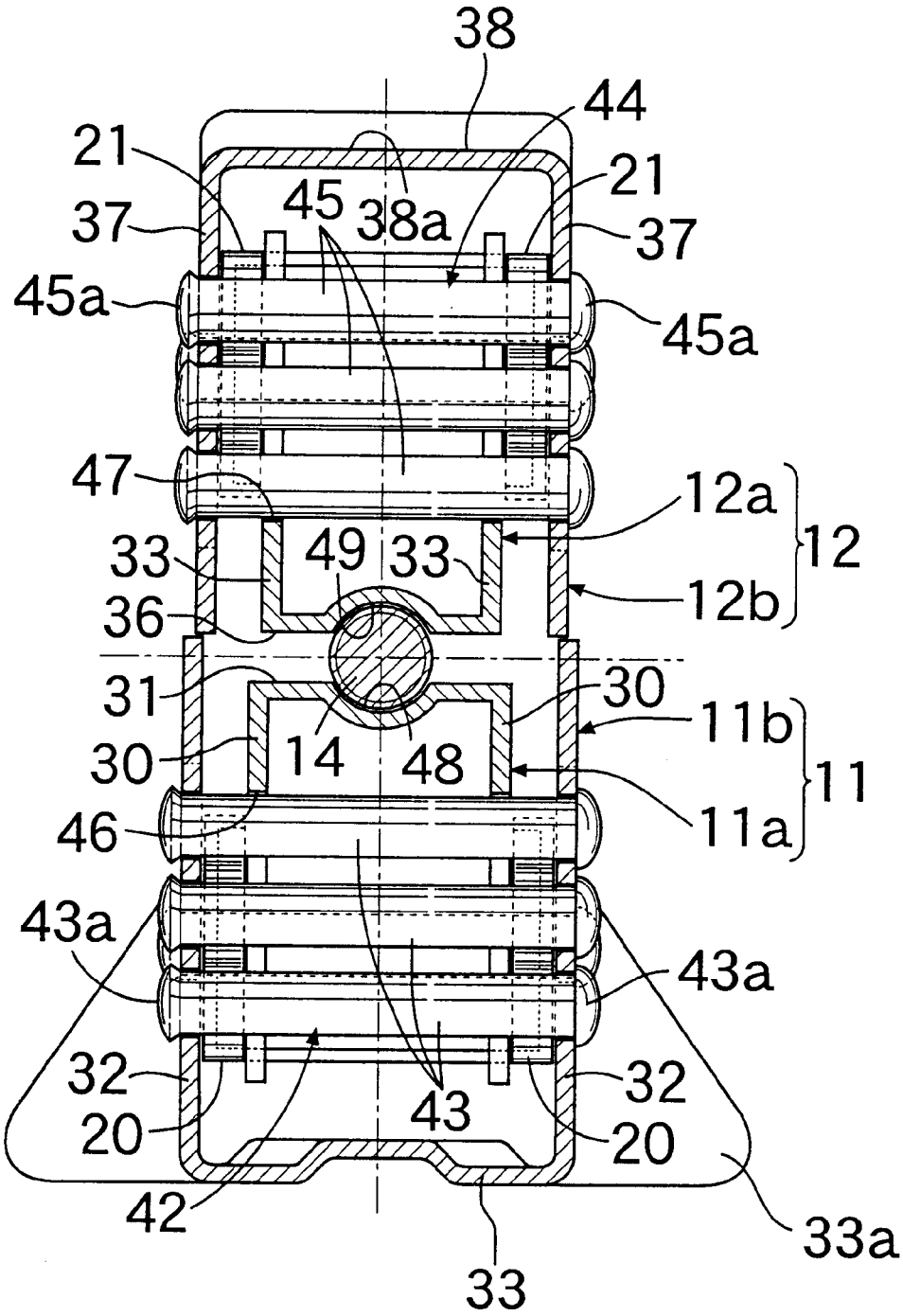
FIG. 4 is a cross-sectional view taken along a line 4—4 in FIG. 2.
Figure 5:
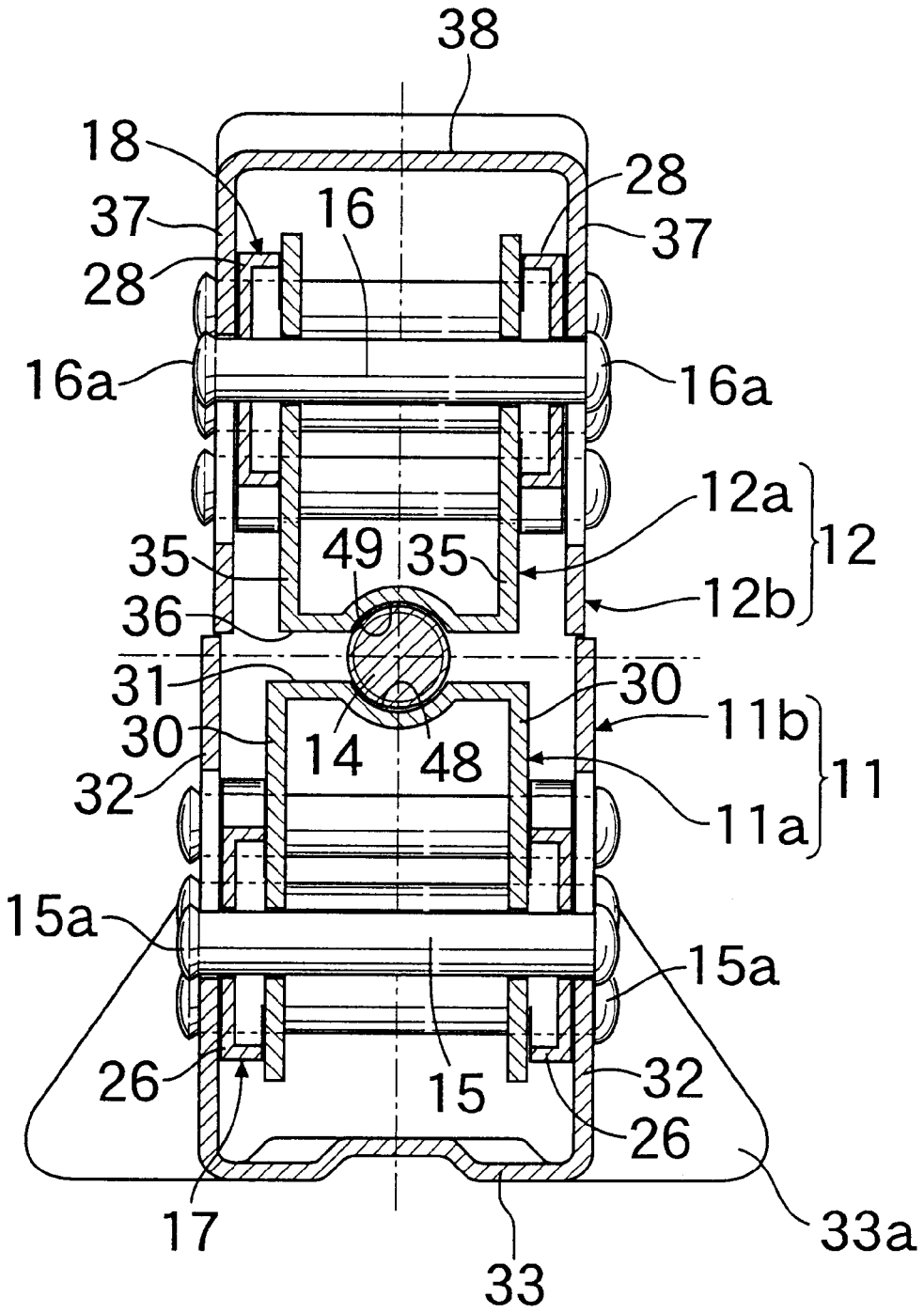
FIG. 5 is a cross-sectional view taken along a line 5—5 in FIG. 2.

As shown in FIG. 2, FIG. 4 and FIG. 5, the aforementioned base 11 comprises an upper base member 11*a* and a lower base member 11*b* which are connected to each other relatively movably in the vertical direction. The upper base member 11*a* is formed by bending a sheet of steel into a U shape and comprises a pair of side walls 30, 30 which oppose to each other in the depth direction, that is to say, in the direction of the width of the jack 10 and a top part 31 which connects upper ends of the side walls 30, 30 integrally with each other. The lower base member 11*b* is also formed by bending a sheet of steel into a U shape and comprises a pair of side walls 32, 32 which oppose to each other in the depth direction with a gap wider than that of the two side walls 30, 30 of the upper base member 11*a* and a bottom part 33 which connects lower ends of the side walls 32, 32 integrally with each other, and the upper base member 11*a* is provided inside the lower base member 11*b* in a vertically movable manner. Ground supports 33*a*, 33*a* are integrally formed with the bottom part 33 of the lower base member 11*b* so as to extend from the right and left ends of the bottom part 33.

The aforementioned load bearing platform 12 comprises a lower load bearing member 12*a* and an upper load bearing member 12*b* which are connected to each other relatively movably in the vertical direction. The lower load bearing platform member 12*a* is formed by bending a sheet of steel into a U shape and comprises a pair of side walls 37, 37 which oppose each other in the depth direction and a bottom part 38 which connects the lower ends of the side walls 37, 37 integrally with each other. The upper load bearing platform member 12*b* is also formed by bending a sheet of steel into a U shape and comprises a pair of side walls 37, 37 which oppose to each other in the depth direction with a gap wider than that of the two side walls 35, 35 of the lower load bearing platform member 12*a* and a top part 38 which links the lower ends of the side walls 37, 37 integrally with each other, and the lower load bearing platform member 12*a* is provided inside the upper load bearing platform member 12*b* in a vertically movable manner. A load bearing channel 38*a* is formed in the depth direction on the top part 38 of the upper load bearing platform member 12*b*. When an automobile body is jacked up, the sidesill of the body is borne by the load bearing channel 38*a*.

The above-mentioned link mechanism 13 comprises a pair of right and left lower arms 17, 17 which are disposed in a V-shaped manner, the inner ends thereof being swingably connected to the upper base member 11*a* via a pair of right and left lower pivots 15, 15, a pair of right and left upper arms 18, 18 which are disposed in an inverted V-shaped manner, the inner ends thereof being swingably connected to the lower load bearing platform member 12*a* via a pair of right and left upper pivots 16, 16, a first connecting shaft 19*a* for swingably connecting the outer ends of lower arm 17 and upper arm 18 on one side and a second connecting shaft 19*b* for swingably connecting the outer ends of lower arm 17 and upper arm 18 on the other side.

Each lower arm 17 is made from a sheet of steel and comprises a pair of side walls 26, 26 which oppose to each other in the depth direction and a bottom part 27 which connects the lower edges of the side walls 26, 26 integrally with each other, and the inner ends of the two side walls 26, 26 are inserted between the side walls 30, 32 of the upper and lower base members 11*a*, 11*b* and connected to the side walls 30, 30 of the upper base member 11*a* via the corresponding aforementioned lower pivot 15.

Each upper arm 18 is also made from a sheet of steel and comprises a pair of side walls 28, 28 which oppose to each other in the depth direction and a top part 29 which connects the upper edges of the side walls 28, 28 integrally with each other, and the inner ends of the two side walls 28, 28 are inserted between the side walls 35, 37 of the lower and upper load bearing platform members 12*a*, 12*b* and connected to the side walls 35, 35 of the lower load bearing platform member 12*a* via the corresponding aforementioned upper pivot 16.

The gap between the side walls 26, 26 of each of the right and left lower arms 17, 17 is made so as to be wider than the gap between the side walls 28, 28 of each of the right and left upper arms 18, 18, and the outer ends of the side walls 28, 28 of each of the two upper arms 18, 18 are interposed between the outer ends of the side walls 26, 26 of each of the two lower arms 17, 17 and these outer ends are connected to each other via the first and second connecting shafts 19*a*, 19*b*.

The lower pivots 15, 15 slidably penetrate two pairs of right and left long bores 40, 40 which are vertically elongated and are provided on each of the two side walls 32, 32 of the lower base member 11*b*, and in order to prevent the pivots 15, 15 from falling out they have expanded ends 15*a*, 15*a* at both ends which are in contact with the outer surfaces of the above-mentioned two side walls 32, 32.

The upper pivots 16, 16 slidably penetrate two pairs of right and left long bores 41, 41 which are vertically elongated and are provided on each of the two side walls 37, 37 of the upper load bearing platform member 12*b*, and in order to prevent them from falling out they have expanded ends 16*a*, 16*a* at both ends which are in contact with the outer surfaces of the above-mentioned two side walls 37, 37.

Lower sector gears 20, 20; 20, 20 which oppose to each other are formed symmetrically on the outer peripheries of the inner ends of each of the two side walls 26, 26; 26, 26 of the right and left lower arms 17, 17, and lower racks 42 which mesh with the lower sector gears 20, 20; 20, 20 are provided in the vertical direction on the lower base member 11*b*. These lower racks 42 comprise a plurality of pins 43 . . . (three pins in the illustrated embodiment) which are provided at vertically identical intervals with both ends supported on the two side walls 32, 32 of the lower base member 11*b*, and the right and left lower sector gears 20, 20; 20, 20 mesh with both the sides of these pins 43 . . . . Here, elongated hole-shaped notches 46, 46 are provided on the two side walls 30, 30 of the upper base member 11*a* in order to avoid interference with each of the pins 43 . . . . Each of the pins 43 . . . has expanded ends 43*a*, 43*a* at both ends which are in contact with the outer surfaces of the lower base member 11*b* in order to prevent them from falling out.

Upper sector gears 21, 21; 21, 21 which oppose to each other are also formed symmetrically on the outer peripheries of the inner ends of each of both the side walls 28, 28; 28, 28 of the right and left upper arms 18, 18, and upper racks 44 which mesh with the upper sector gears 21, 21; 21, 21 are provided in the vertical direction on the upper load bearing platform member 12*b*. These upper racks 44 comprise a plurality of pins 45 . . . (three pins in the illustrated embodiment) which are provided at vertically identical intervals with both ends supported on both the side walls 37, 37 of the upper load bearing platform member 12*b*, and the right and left upper sector gears 21, 21; 21, 21 mesh with both the sides of these pins 45 . . . . Here, elongated hole-shaped notches 47, 47 are provided on the two side walls 35, 35 of the lower load bearing platform member 12*a* in order to avoid interference with each of the pins 45 . . . . Each of the pins 45 . . . has expanded ends 45*a*, 45*a* at both ends which are in contact with the outer surfaces of the upper load bearing platform member 12*b* in order to prevent them from falling out.

Figure 6:
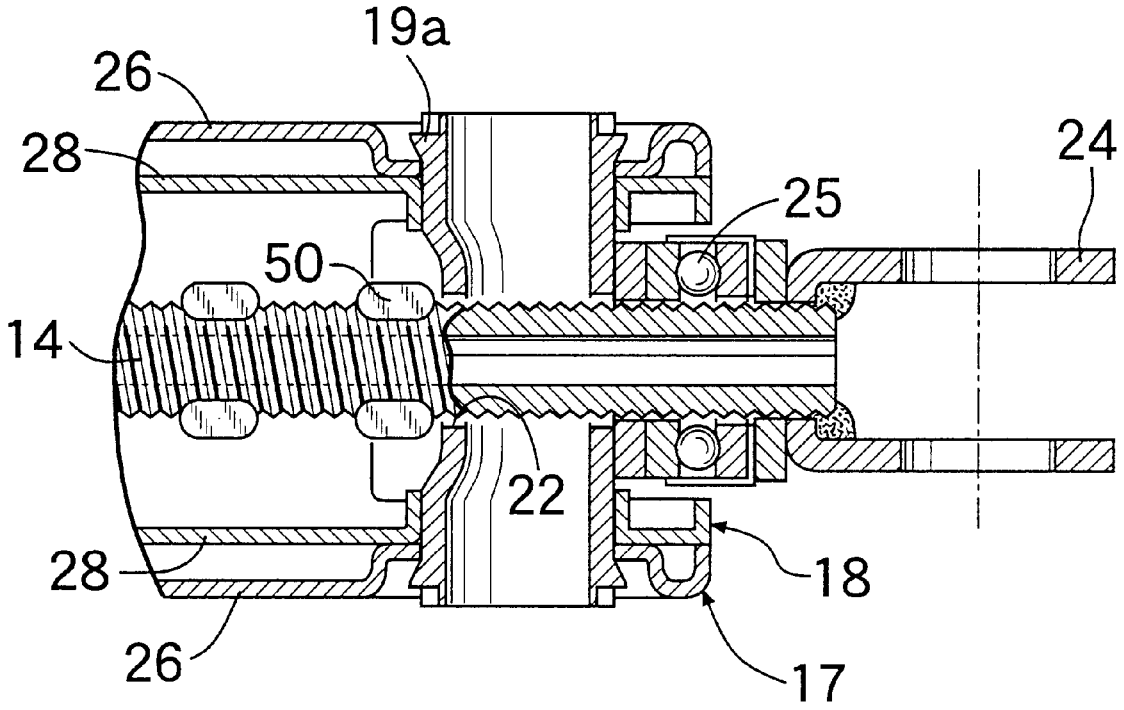
FIG. 6 is a cross-sectional view taken along a line 6—6 in FIG. 1.
Figure 7:
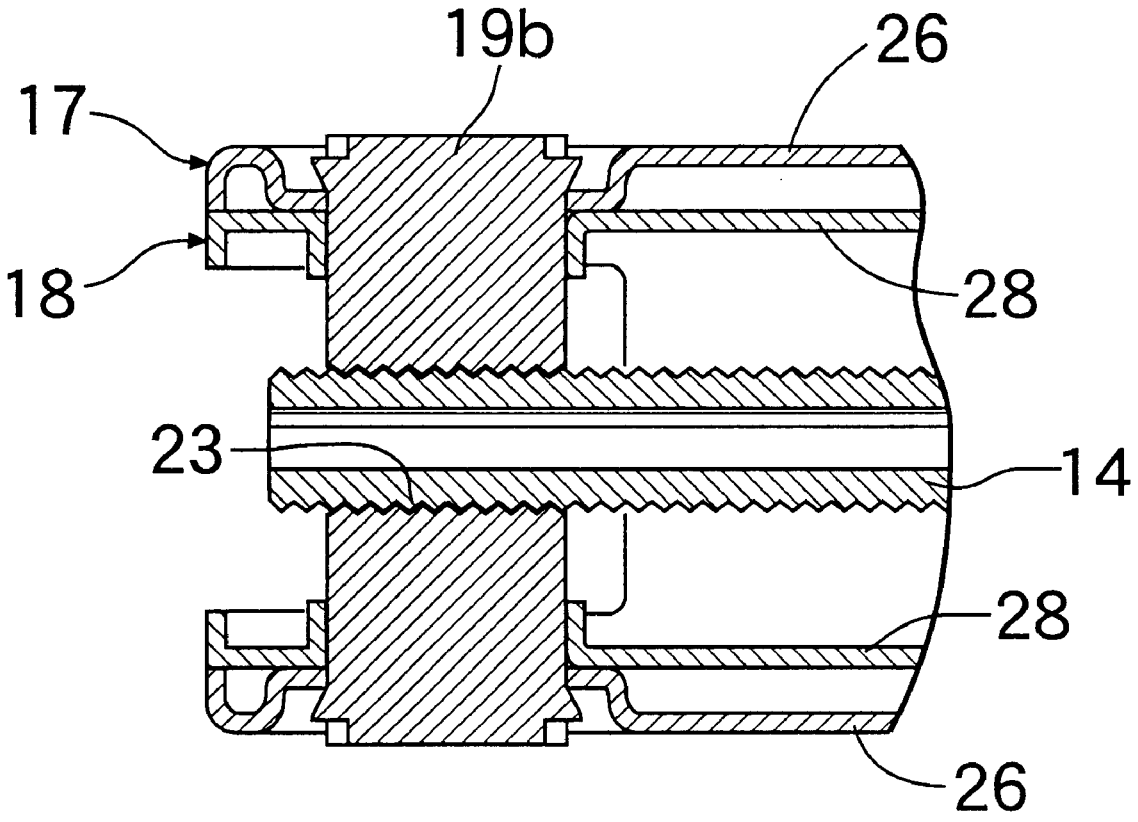
FIG. 7 is a cross-sectional view taken along a line 7—7 in FIG. 1.

As shown in FIG. 6 and FIG. 7, the first connecting shaft 19*a* is made from a hollow tube and is provided at its centre with a shaft hole 22 which is orthogonal to its axis. The second connecting shaft 19*b* is solid and is provided at its centre with a threaded hole 23 which is orthogonal to its axis, one end of the threaded rod 14 is fitted rotatably into the above-mentioned axis hole 22, and the other end of the above-mentioned rod 14 is screwed into the threaded hole 23.

A yoke joint 24 is secured by welding to one end of the threaded rod 14 on the side corresponding to the first connecting shaft 19*a*, a thrust bearing 25 is mounted so as to adjoin the yoke joint 24, and the threaded rod 14 can be connected to the first connecting shaft 19*a* in an axially non-movable manner by positioning the thrust bearing 25 and an extrusion 50 formed on the outer peripheral surface of the threaded rod 14 so as to be in contact with both the side surfaces of the first connecting shaft 19*a*.

As shown in FIG. 4 and FIG. 5, recesses 48, 49 for receiving one portion of the outer peripheral surface of the threaded rod 14 when the jack 10 is collapsed are formed on the upper wall part 31 of the upper base member 11*a* and the bottom wall part 36 of the lower load bearing platform member 12*a*, and thus it is possible to reduce the height of the collapsed jack 10 as much as possible.

Next, the operation of the present embodiment is described.

When the jack 10 is in a collapsed state as shown in FIG. 1 (the solid line) and FIG. 2, by rotating the threaded rod 14 in the clockwise direction by means of a rotation tool (not illustrated) connected to the yoke joint 24 the first and second connecting shafts 19*a*, 19*b* approach each other, thereby resulting in the lower arms 17, 17 and the upper arms 18, 18 starting to erect around the lower pivots 15, 15 and the upper pivots 16, 16 respectively to lift the load bearing platform 12.

Figure 3:
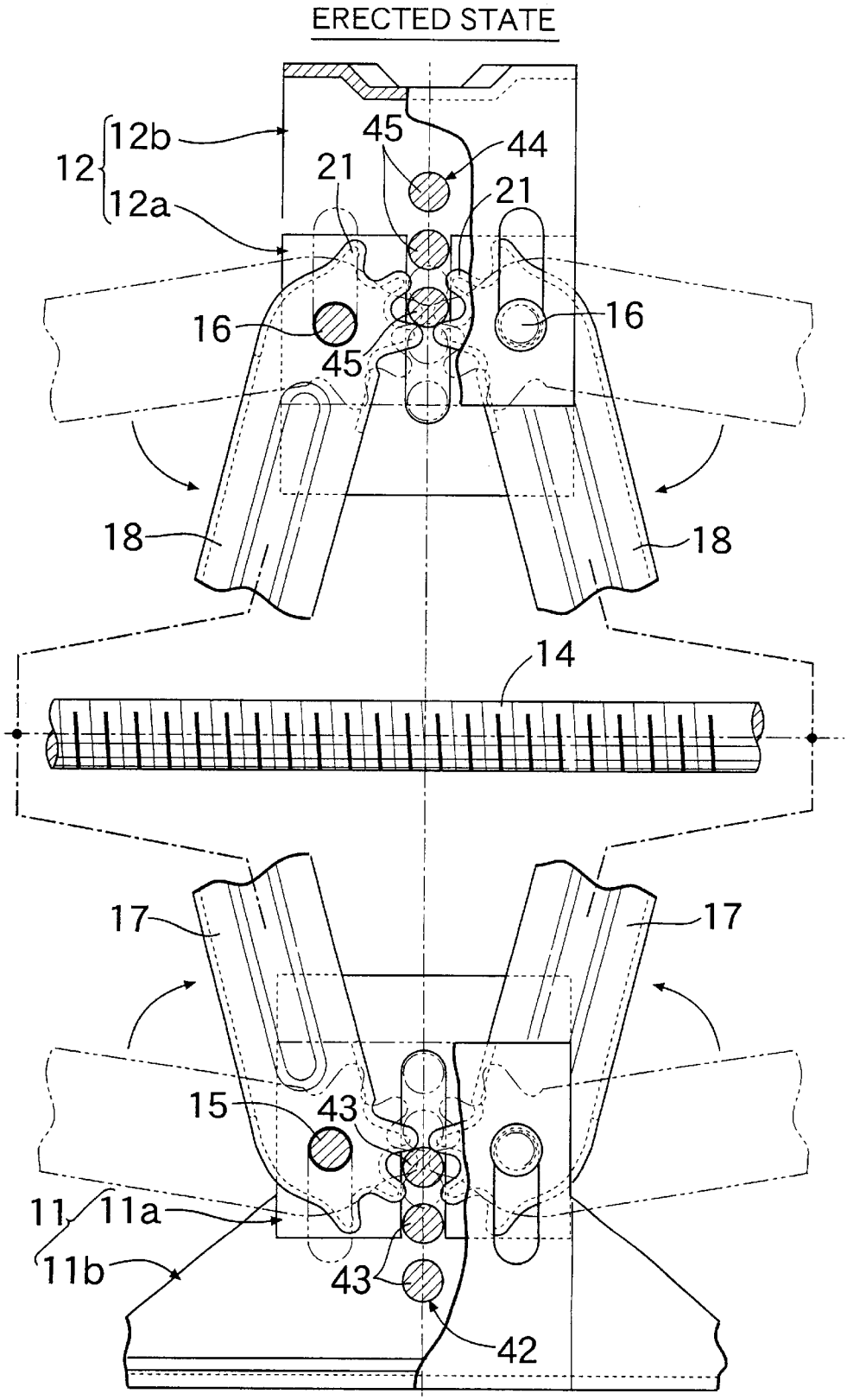
FIG. 3 is a partially cut away front view showing a state in which the jack is erected.

Simultaneously, while the lower arms 17, 17 are erecting around the lower pivots 15, 15, since the lower sector gears 20, 20 rotate so as to ascend the lower racks 42 as shown in FIG. 3, the upper base member 11*a* having the lower pivots 15, 15 lifts relative to the lower base member 11*b* having the lower racks 42. While the upper arms 18, 18 are erecting around the upper pivots 16, 16, since the upper sector gears

21, 21 rotate so as to push up the upper racks 44 as shown in FIG. 3, the upper load bearing platform member 12*b* having the upper racks 44 lifts relative to the lower load bearing platform member 12*a* having the upper pivots 16, 16.

As a result, the total amount of lift of the jack 10 becomes the sum of the amount of lift of the load bearing platform 12 due to the erection of the lower arms 17, 17 and the upper arms 18, 18, the amount of lift of the upper base member 11*a* relative to the lower base member 11*b*, and the amount of lift of the upper load bearing platform 12*b* relative to the lower load bearing platform 12*a*, and thus it is possible to increase the amount of lift to a great extent in comparison with that of a lack of the art in which the amount of lift of the load bearing platform 12 is determined only by the erection of the lower arms 17, 17 and the upper arms 18, 18. Moreover, since there is no special need to increase the lengths of the lower arms 17, 17, the upper arms 18, 18 and the threaded rod 14, the size of the jack 10 can be prevented from increasing.

Since the lower racks 42 comprise a plurality of pins 43 . . . which are provided at vertically identical intervals and whose both ends are supported on the two side walls 32, 32 of the lower base member 11*b* and the right and left lower sector gears 20, 20 mesh with both sides of these pins 43 . . . , only one set of lower racks 42 which is shared by the right and left lower sector gears 20, 20 will suffice. Since the upper racks 44 comprise a plurality of pins 45 . . . which are provided at vertically identical intervals with both ends supported on the two side walls 37, 37 of the upper load bearing platform member 12*b* and the right and left upper sector gears 21, 21 mesh with both sides of these pins 45 . . . , only one set of upper racks 44 which is shared by the right and left upper sector gears 21, 21 will suffice. Thus, the arrangement can be simplified.

When the jack 10 is in an erect state, by rotating the threaded rod 14 in the reverse direction, the lower arms 17, 17 and the upper arms 18, 18 collapse around the lower pivots 15, 15 and the upper pivots 16, 16 respectively due to an action opposite to the above-mentioned action, the upper base member 11*a* descends relative to the lower base member 11*b*, the upper load bearing platform member 12*b* descends relative to the lower load bearing platform member 12*a*, and thus it is apparent that the jack 10 collapses.

The present invention is not limited to the above-mentioned embodiment and can be modified in a variety of ways without departing from the spirit and scope of the invention.

What is claimed is:

1. A pantagraph-type jack in which outer ends of a pair of lower arms disposed in a V-shaped manner whose inner ends are swingably connected to a base and outer ends of a pair of upper arms disposed in an inverted V-shaped manner whose inner ends are swingably connected to a load bearing platform are connected via first and second connecting shafts, and a threaded rod supported on the first connecting shaft in a rotatable but axially non-movable manner is screwed into a threaded bore provided in said second connecting shaft, wherein said base comprises an upper base member and a lower base member which are connected to each other relatively movably in a vertical direction, inner ends of said pair of lower arms are swingably connected to the upper base member via a pair of lower pivots arranged in a horizontal direction, lower sector gears are formed on outer peripheries of the inner ends of said two lower arms, and a lower rack which meshes with said lower sector gears is disposed in the vertical direction and secured on said lower base member.

2. A pantagraph-type jack in which outer ends of a pair of lower arms disposed in a V-shaped manner whose inner ends are swingably connected to a base and outer ends of a pair of upper arms disposed in an inverted V-shaped manner whose inner ends are swingably connected to a load bearing platform are connected via first and second connecting shafts, and a threaded rod supported on the first connecting shaft in a rotatable but axially non-movable manner is screwed into a threaded bore provided in said second connecting shaft, wherein said load bearing platform comprises a lower load bearing platform member and an upper load bearing platform member which are connected to each other relatively movably in a vertical direction, inner ends of the pair of upper arms are swingably connected to said lower load bearing platform member via a pair of upper pivots arranged in a horizontal direction, upper sector gears are formed on outer peripheries of the inner ends of said two upper arms, and an upper rack which meshes with said upper sector gears is disposed in the vertical direction and secured on said upper load bearing platform member.

3. A pantagraph-type jack in which outer ends of a pair of lower arms disposed in a V-shaped manner whose inner ends are swingably connected to a base and outer ends of a pair of upper arms disposed in an inverted V-shaped manner whose inner ends are swingably connected to a load bearing platform are connected via first and second connecting shafts, and a threaded rod supported on the first connecting shaft in a rotatable but axially non-movable manner is screwed into a threaded bore provided in said second connecting shaft, wherein said base comprises an upper base member and a lower base member which are connected to each other relatively movably in a vertical direction, inner ends of said pair of lower arms are swingably connected to the upper base member via a pair of lower pivots arranged in a horizontal direction, lower sector gears are formed on outer peripheries of the inner ends of said two lower arms, and a lower rack which meshes with the lower sector gears is disposed in the vertical direction and secured on said lower base member, and said load bearing platform comprises a lower load bearing platform member and an upper load bearing platform member which are connected to each other relatively movably in a vertical direction, inner ends of the pair of upper arms are swingably connected to said lower load bearing platform member via a pair of upper pivots arranged in a horizontal direction, upper sector gears are formed on outer peripheries of the inner ends of said two upper arms, and an upper rack which meshes with said upper sector gears is disposed in the vertical direction and secured on said upper load bearing platform member.

4. A pantagraph-type jack according to any one of claims 1 to 3, wherein said rack comprises a plurality of pins which are inserted in a vertical array on a corresponding one of said lower base member and upper load bearing platform members, and both sides of these pins are made to mesh with a corresponding pair of sector gears.

* * * * *